US008360293B2

(12) United States Patent
Hamman

(10) Patent No.: US 8,360,293 B2
(45) Date of Patent: Jan. 29, 2013

(54) METHOD FOR ANCHORING PIN INSERTION

(75) Inventor: Carl R. Hamman, Mt Sterling, OH (US)

(73) Assignee: Nancy's Blankets, LLC, Mt. Sterling, OH (US)

( * ) Notice: Subject to any disclaimer, the term of this patent is extended or adjusted under 35 U.S.C. 154(b) by 0 days.

(21) Appl. No.: 13/435,029

(22) Filed: Mar. 30, 2012

(65) Prior Publication Data

US 2012/0189391 A1 Jul. 26, 2012

Related U.S. Application Data

(60) Division of application No. 12/407,804, filed on Mar. 20, 2009, now Pat. No. 8,152,040, which is a continuation-in-part of application No. 11/385,362, filed on Mar. 21, 2006, now abandoned.

(60) Provisional application No. 60/663,657, filed on Mar. 21, 2005.

(51) Int. Cl.
*B25C 1/02* (2006.01)

(52) U.S. Cl. ..... 227/140; 294/65.5; 81/44; 335/285

(58) Field of Classification Search ..... 227/140, 227/156; 294/65.5; 335/285; 173/90; 405/259.1; 81/44; 47/1.01 F
See application file for complete search history.

(56) References Cited

U.S. PATENT DOCUMENTS

| | | | | | |
|---|---|---|---|---|---|
| 337,212 | A | * | 3/1886 | Van Dusen | 81/44 |
| 350,420 | A | * | 10/1886 | Dillon | 227/147 |
| 493,758 | A | * | 3/1893 | Davidson | 81/44 |
| 1,852,956 | A | * | 4/1932 | Czichos | 473/284 |
| 2,690,617 | A | * | 10/1954 | Giern et al. | 433/147 |
| 2,947,563 | A | * | 8/1960 | Stitt | 294/65.5 |
| 3,034,025 | A | * | 5/1962 | Budreck et al. | 335/295 |
| 3,036,482 | A | * | 5/1962 | Kenworthy et al. | 173/90 |
| 3,549,075 | A | * | 12/1970 | Yasuhiko | 227/63 |
| 3,646,492 | A | * | 2/1972 | Westermann | 335/285 |
| 3,934,779 | A | * | 1/1976 | Dent | 227/147 |
| 3,979,040 | A | * | 9/1976 | Denin | 227/113 |
| 4,073,327 | A | * | 2/1978 | Pearson | 81/24 |
| 4,162,471 | A | * | 7/1979 | Peace et al. | 335/291 |
| 4,627,563 | A | * | 12/1986 | Meyer | 227/130 |
| 4,633,563 | A | * | 1/1987 | Rykaczewski | 29/270 |
| 4,706,864 | A | * | 11/1987 | Jacobsen et al. | 227/109 |
| 4,802,702 | A | * | 2/1989 | Bownds | 294/65.5 |
| 5,062,672 | A | * | 11/1991 | Harris | 294/65.5 |
| 5,163,597 | A | * | 11/1992 | Napoli et al. | 227/140 |
| 5,265,887 | A | * | 11/1993 | Stelmach | 294/65.5 |
| 5,718,646 | A | * | 2/1998 | Brewer | 473/386 |
| 5,782,149 | A | * | 7/1998 | Jensen | 81/125 |
| 5,810,409 | A | * | 9/1998 | Hardie | 294/65.5 |
| 5,875,950 | A | * | 3/1999 | Nuss et al. | 227/113 |
| 5,945,901 | A | * | 8/1999 | Coleman et al. | 335/285 |
| 5,988,296 | A | * | 11/1999 | Zachman et al. | 173/1 |
| 5,997,213 | A | * | 12/1999 | Dennis et al. | 405/114 |
| 6,124,777 | A | * | 9/2000 | Snider | 335/285 |
| 6,220,121 | B1 | * | 4/2001 | Leete | 81/44 |
| 6,260,980 | B1 | * | 7/2001 | Ping | 362/120 |
| 6,273,833 | B1 | * | 8/2001 | Murphy | 473/386 |
| 6,325,433 | B1 | * | 12/2001 | Nicholson et al. | 294/65.5 |
| 6,489,871 | B1 | * | 12/2002 | Barton | 335/285 |
| 6,585,456 | B2 | * | 7/2003 | Forse | 405/259.1 |

(Continued)

*Primary Examiner* — Lindsay Low
(74) *Attorney, Agent, or Firm* — Mueller Law, LLC; Jerry K. Mueller, Jr.

(57) ABSTRACT

A method utilizing a device capable of mounting an anchoring pin and then inserting the pin into the ground or other penetrable surface includes a hand-graspable elongate handle having an upper under and a lower end and a magnetic puck assembly fixed to the handle lower end for picking up an anchoring pin and maintaining in an insertion position until the pin is inserted into the ground. The method can be used to insert marker pins, or pins for retaining materials on a surface, such as the surface of an erodable waterway.

20 Claims, 5 Drawing Sheets

U.S. PATENT DOCUMENTS 6,648,203 B2 * 11/2003 Lord ..... 227/147
6,677,845 B1 * 1/2004 Fader et al. ..... 335/285
6,968,989 B1 * 11/2005 Hall, Jr. ..... 227/147
7,131,678 B2 * 11/2006 Ernesti ..... 294/65.5
2004/0012215 A1 * 1/2004 Chang ..... 294/65.5

* cited by examiner

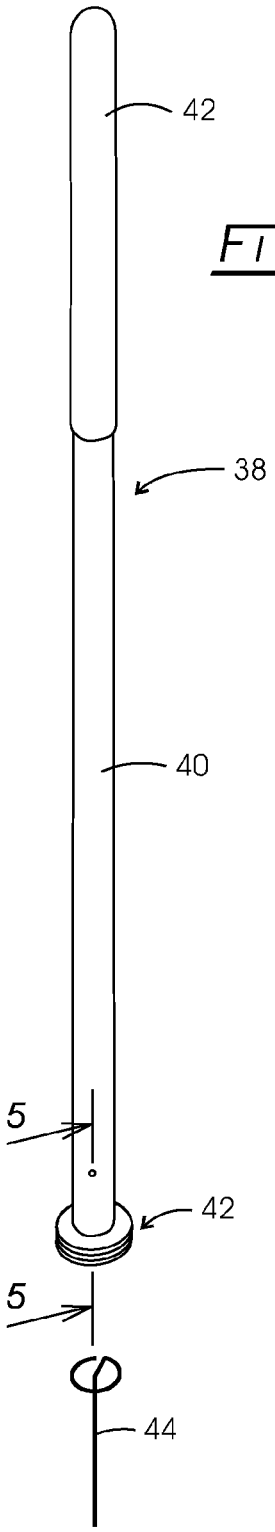
FIG. 4
FIG. 5
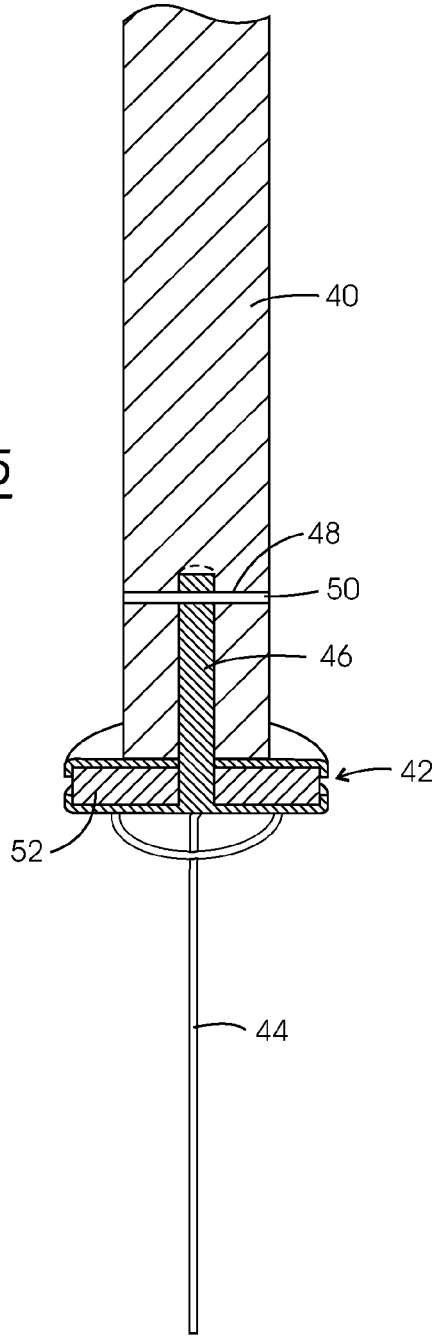

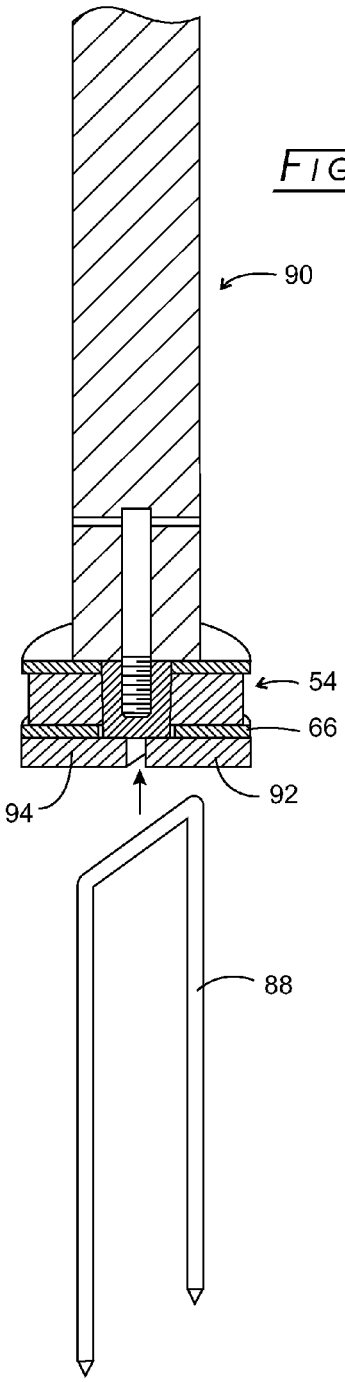
FIG. 10
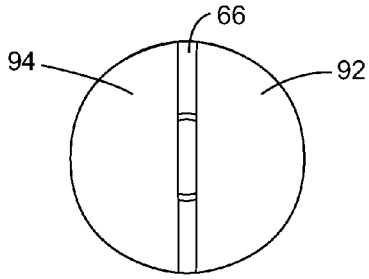
FIG. 11
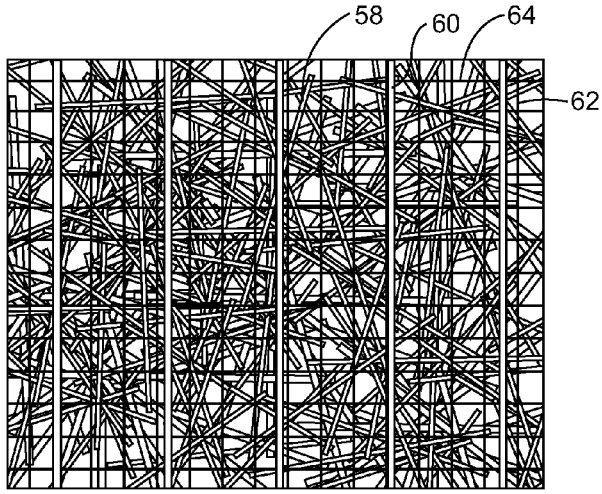
FIG. 12
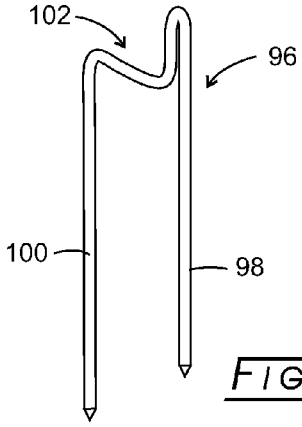
FIG. 13
FIG. 14
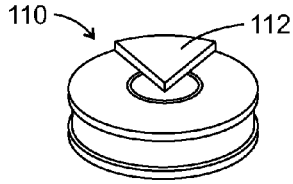

METHOD FOR ANCHORING PIN INSERTION

CROSS-REFERENCE TO RELATED APPLICATIONS

This application is divisional application of U.S. patent application Ser. No. 12/407,804, filed Mar. 20, 2009, now U.S. Pat. No. 8,152,040, to be issued Apr. 10, 2012, which is a continuation-in-part of application Ser. No. 11/385,362, filed on Mar. 21, 2006; and claims benefit of provisional application Ser. No. 60/663,657, filed Mar. 21, 2005, the disclosures of which are expressly incorporated herein by reference.

STATEMENT REGARDING FEDERALLY SPONSORED RESEARCH

Not applicable.

BACKGROUND

The present disclosure generally relates to anchoring pins for matting and geotextile materials and more particularly to a unique anchoring pin insertion unit.

It is becoming common practice to lay erosion control materials, such as, for example, matting or geotextile materials fabric, over grass seedlings or sod, particularly on sloping ground bordering roads and highway interchanges. Anywhere that water is expected to form a stream, such erosion control can be, and currently is being, practiced. Such waterways can be natural or man-made. Regardless of the formation of the waterway, erosion control dictates that a bed of grass be installed in the portion of the waterway where water is carried.

In other instances, mulch netting can be positioned over a bed of mulch to hold the mulch in place. Such netting is required, then, to be held in position such as, for example, by anchoring pins.

In practice, the anchoring pins can be driven into the ground using a hammer. This is a laborious task requiring the worker to be on hands and knees. Alternatively, a hand-operable device for inserting the anchoring pins while the worker remains standing can be used, such as, for example, typified by U.S. Pat. No. 6,585,456. A major drawback to such devices is the ability of the worker to mate the anchoring pin or staple with the device in such a manner that the worker can remain standing and in easy fashion so that the productivity of the worker does not suffer.

Of more recent vintage is the growing of sod using a plastic webbing laid over the ground before the grass seed germinates. Such sod growing technique permits thinner layers of sod to be harvested in rolls, rather than squares, as has typically been the practice. Such rolls of sod can be held to the ground, especially on hillsides, using the same pinning technique as has been common in waterway construction.

It is to a device that can be used to pin insertion in the field that the present disclosure is addressed.

BRIEF SUMMARY

A hand-operable device of mounting a metallic anchoring pin and inserting the pin into the ground includes a hand-graspable elongate handle having an upper under and a lower end and a magnetic puck assembly fixed to the handle lower end for picking up an anchoring pin and maintaining in an insertion position until the pin is inserted into the ground. For present purposes, a "metallic" anchoring pin is defined as a pin which either is made from magnetic material or is modified to have an area that is capable of being attracted to and held by a magnetic (a magnetic material), such as, for example, by coating with a metallic paint, imbedding a magnetic piece, or otherwise associating a metallic piece with a non-metallic pin. For present purposes, "magnetic" means a material that is attracted by a magnetic and which can be magnetized. For present purposes, "planar" for two or more components means that neither component is recessed nor protruding with respect to each other, i.e., they present a planar surface.

The disclosed magnetic puck assembly for picking up a metallic anchoring pin and maintaining it in an insertion position until the pin is inserted into the ground includes an upper magnetic mounting ring having a central aperture, a lower magnetic bearing ring having a central aperture and an outer bearing surface, an annular magnet sandwiched between the upper mounting ring and the lower bearing ring (and having a central aperture) and a magnetic tapered pin inserted within all of the central apertures and being in contact with the upper mounting ring, but being spaced apart from the lower bearing ring and having an attachment end and a bearing end. The tapered pin bearing end and said lower ring outer bearing surface form a planar surface for retaining a metallic anchoring pin for its insertion into the ground.

BRIEF DESCRIPTION OF THE DRAWINGS

For a fuller understanding of the nature and advantages of the present disclosure, reference should be had to the following detailed description taken in connection with the accompanying drawings, in which:

FIG. 4 is a perspective view of another embodiment of the inventive device showing an alternative, and presently preferred, device;

FIG. 5 is a sectional view taken along line 5-5 of FIG. 4;

FIG. 10 is a sectional view like that in FIGS. 3, 5, and 6, but where the magnetic puck assembly has been modified to accept a staple;

FIG. 11 is a bottom view of the magnetic puck assembly for staples shown in FIG. 10;

FIG. 12 is an enlarged view of the waterway matte shown generally in FIG. 1;

FIG. 13 is a perspective view of another staple embodiment where the top or head is formed into the shape of a "V"; and FIG. 14 is a perspective view of another magnetic puck embodiment adapted for use with the V-top staple illustrated in FIG. 13.

The drawings will be described in further detail below.

DETAILED DESCRIPTION

Figure 1:
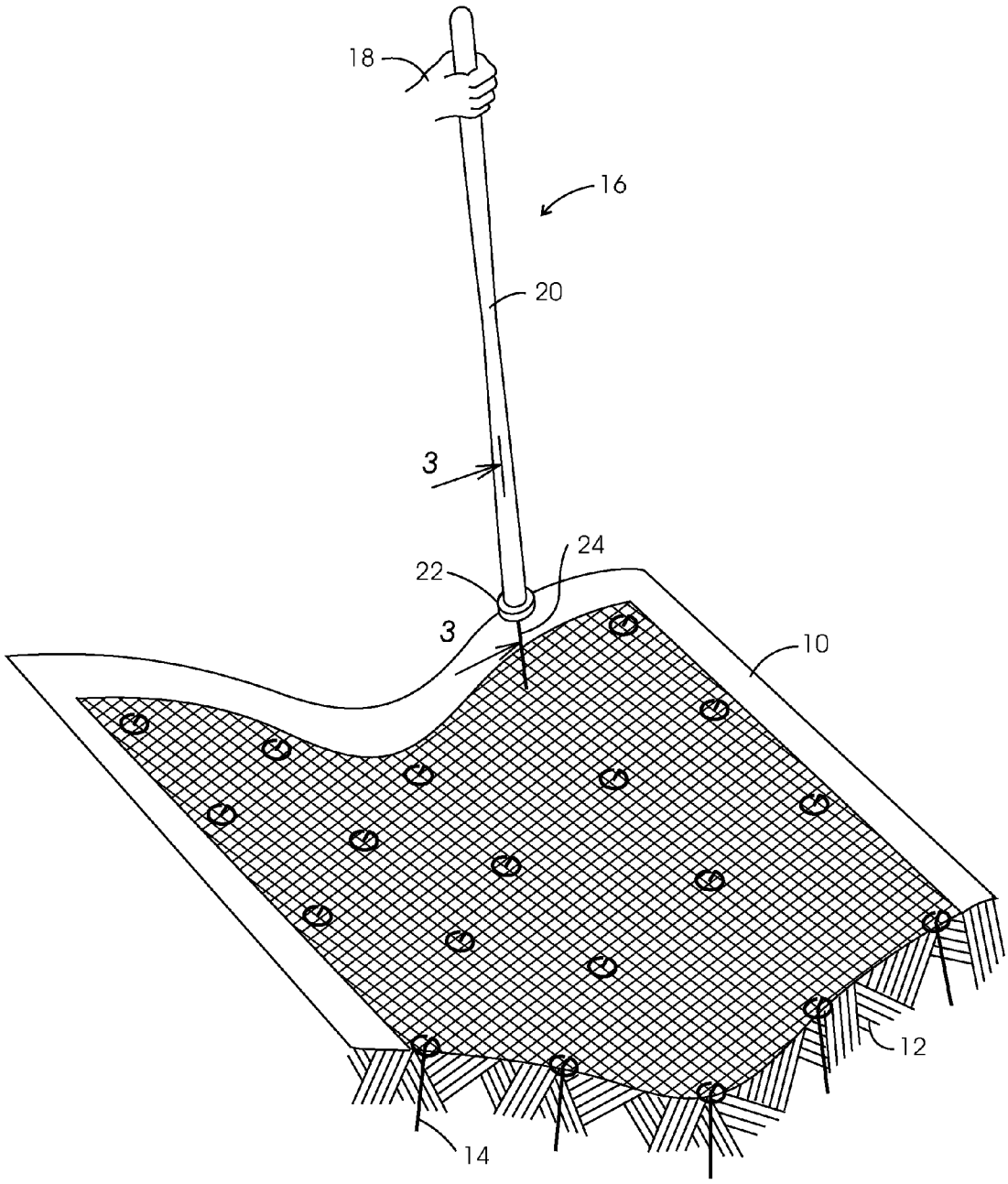
FIG. 1 a perspective view of an anchoring pin insertion device in an operable position inserting an anchoring pin into the ground to securing matting to the ground.

Referring initially to FIG. 1, matting, 10, is placed on the ground, 12, which can be a waterway. Matting 10 conforms to the shape of ground 12 and is held in position by a number of anchoring pins or staples, an example of such pins being pin 14. The pins may all be configured like pin 14 or can be a mix of a variety of pin configurations. Ground 12 already has been seeded with grass or other suitable planting material for preventing and/or opposing erosion of the soil. A variety of grasses, ground cover, or other planting material is well known in this field and requires no further description herein. Similarly, the composition and details of matting 10 is well known in the field and requires little further description herein. An example of one matting is seen in FIG. 12, where strong strands of straw, 58, is seen held in place by a series of ostensibly parallel strands of material, such as, strand 60, and a web of vertical and horizontal strands, such as strands 62 and 64. In the particular matte in FIG. 12, the vertical only strands, such as strand 60, is larger than the smaller checkered strands, 62 and 64. Of course, a variety of similar and different waterway matting is available, all of which can be anchored by the anchoring insertion unit disclosed herein.

In order for a worker to remain standing and insert the anchoring pins into ground 12 for securing matting 10 to ground 12, the inventive pin insertion device, 16, is shown in an operating position held by a worker's hand, 18. Terminating the lower end of an elongate handle, 20, is a magnetic puck assembly, 22, holding a pin, 24, for its insertion through matting 10 and into ground 12.

Figure 2:
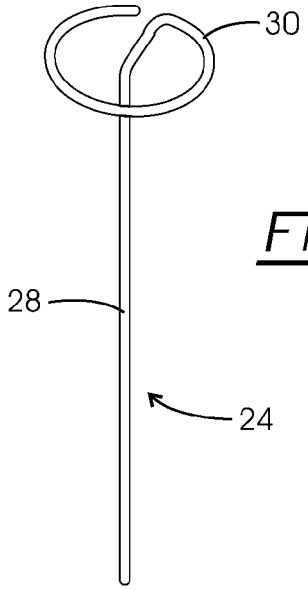
FIG. 2 is a perspective view of an anchoring pin or staple useful with the inventive device.

Referring now to FIG. 2, a typical staple or anchoring pin, 24, is formed from an elongate shaft, 28, and an upper head, 30. Pin 24 is formed from metal wire of suitable content to resist premature oxidation or breakdown in use. Thus, the thickness is sufficient to permit insertion into the ground. It need not last for too long of a time inasmuch as the matting is required only for permitting the seed or seedlings time to mature. At that time, the matting and pins have served their useful purpose.

Head 30 also is made from the same metal wire; although, it could be made of a different material, have a different thickness wire, or the like. Requirements of head 30 also include the ability to bear the force exerted for insertion of pin 24 into the ground. For present purposes, head 30 needs to be made from magnetic material or coated with magnetic material. Shaft 28 need not be made from magnetic material, but can be.

Figure 3:
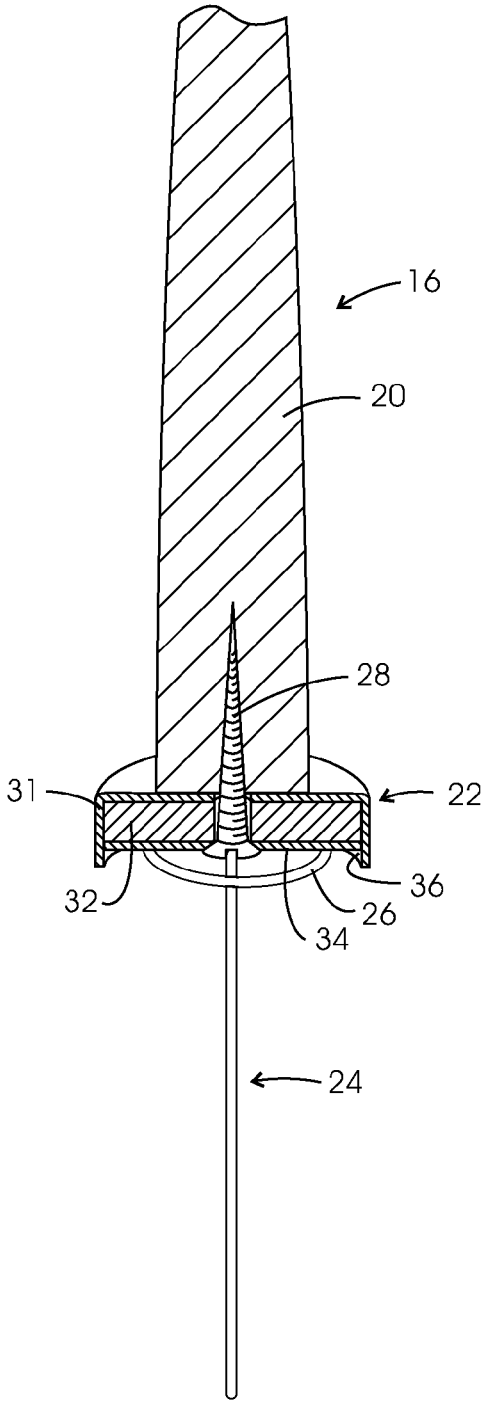
FIG. 3 is sectional view taken along line 3-3 or FIG. 1.

Referring to FIG. 3, magnetic assembly or puck 22 of device 16 retains pin 24 by magnetically engaging the head, 26, or pin 24. Puck 22 is connected to handle or shaft 20 by a screw, 28. Magnetic puck 22 in the embodiment illustrated in FIG. 3 is formed from an outer casing, 30, that houses a magnet, 32. Both casing 31 and magnetic 32 are annular in shape with the inner aperture permitting insertion of screw 28. Casing 30 may be made of magnetic material or of non-magnetic material. Inner annular magnet 32 has sufficient magnetic strength for carrying the weight of pin 24 by picking up pin 24 and then inserting pin 24 into ground 12. The lower surface or magnetic pin plate, 34, of case 30 is relative flat and smooth for mating with head 26 of pin 24.

In order to urge head 26 to be co-extensive with puck 22 and not extend beyond the outer edge of puck 22, an outer protruding lip, 36, is formed to extend from case 30. Thus, when pin 24 is picked up by the worker from the ground or a bin, head 30 will center or self-center onto puck 22 with lip 36 assisting in such centering. The strength of magnet 32, the composition of pin 24, and like factors will enable the manufacturer to select the material for case 30 and lower surface 34, their thickness, and the like factors. After insertion of pin 24 into ground 12, the user need only lift up on handle 20 to detach handle 20 from pin 24. In fact, if pin 24 is pulled out of the ground by lifting up on handle, 20, then the pin was insufficiently stuck into the ground. In that sense, puck 22 is self-monitoring for determining whether pin 24 will be retained by the ground in which it was inserted. Pivoting of handle 20 slightly about puck 22 to dislodge puck 22 from pin 24 ordinarily is not needed, excepting for sandy and very loose soil.

The embodiment in FIG. 4, depicts the device, 38, composed of an upper elongate handle or shaft, 40, overfitted with a padded sleeve, 42, a lower magnetic puck, 42, for insertion of a pin, 44. Viewing FIG. 5, magnetic puck 42 is retained a dowel, 46, that inserts into shaft 40. Shaft 40 has a transverse aperture, 48, which mates with an aperture in dowel 46 such that a retaining peg, 50, inserted into aperture 48 and through dowel 46 holds puck 42 securely to shaft 40 of device 38. As presently designed, the magnet, 52, housed within puck 42 is about 2.5" in diameter and about 0.5" in thickness. The height of puck 42 and dowel 46 is about 3.5" and shaft/handle 40 is about 45" in length.

Figure 6:
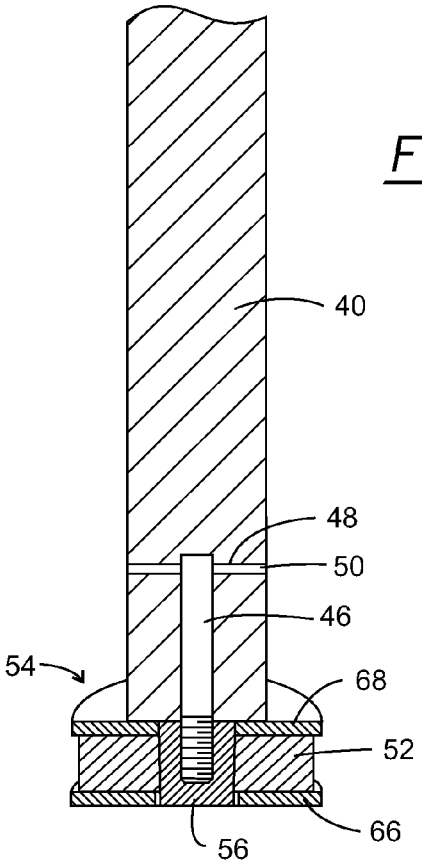
FIG. 6 is a sectional view like that in FIG. 5, but with an alternative shaft attachment.

In the preferred embodiment of FIG. 6, a magnet puck, 54, bears dowel 46, which has been joined by a threaded end. Such construction enables the bottom end of shaft/handle 40 bear directly upon the puck case so that puck 54 can bear more applied force (weight) for superior performance.

Figure 7:
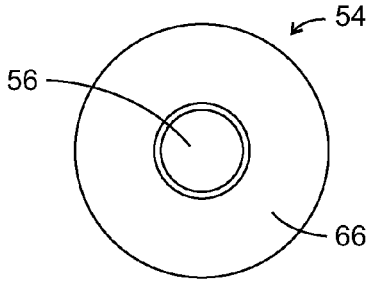
FIG. 7 is a bottom view of the magnetic puck assembly of FIG. 6.

Referring now to FIGS. 6 and 7, a lower bearing ring or magnetic pin plate, 66, is mated with the pins for their insertion into the ground. Interiorly in puck 54, an aperture is formed in a funnel or tapered configuration for a similarly shaped (tapered) pole pin, 56, to be inserted into such aperture. While tapered pole pin 56 can touch upper an upper ring, 68, of magnetic puck 54, lower ring 66 is spaced apart from tapered pole pin 56 in order to create extra magnetic edges or poles, which increases the magnetic strength of puck 54 for retaining pins and inserting pins into the ground.

Figure 8:
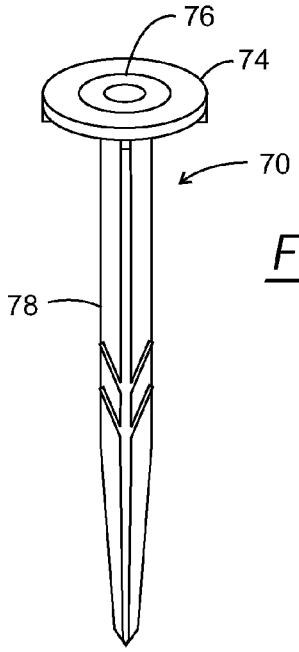
FIG. 8 is yet another anchoring pin configuration.
Figure 9:
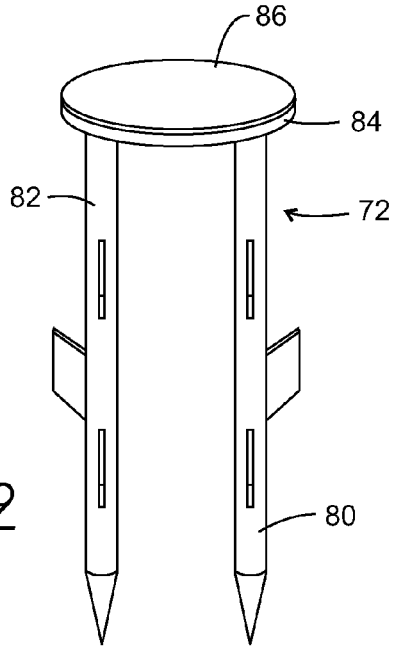
FIG. 9 is yet a further anchoring pin configuration.

Additional pin configurations are shown in FIGS. 8 and 9. Pins 70 and 72 are not made of metal and are not magnetic. Pin 70 is made from a plastic material, usually a scrap plastic of low value. Inserted into its head, 74, is a metal ring, such as a metal annulus or washer, 76, which enables the magnetic pucks to pick up and retain pin 70 for its insertion into the ground. A single barbed shaft, 78, completes pin 70.

Pin 72 in FIG. 9 can made from biodegradable material, such as biodegradable cornstarch or the like. Pin 72 has a pair of barbed legs, 80 and 82. A head, 84, has metallic coating, 86, applied thereto. Coating 86 can contain iron oxide, iron filings, or other metal (metal oxide) material that is attracted to a magnet of the magnetic pucks. Other techniques for making plastic pins have "magnetic" heads for being picked up by the magnetic pucks will be readily apparent to those skilled in the art based on the disclosure set forth herein.

Another prevalent pin for attaching waterway matting to the ground are elongate staples, such as staple 88 in FIG. 10. By altering the design of the magnetic puck, the inventive insertion units can pick up staples and insert them into the ground. An insertion device, 90, is formed like the device in FIG. 6, including the magnetic puck. In this staple embodiment, however, a pair of spaced-apart non-magnetic shims (e.g., aluminum or stainless steel), 92 and 94, have been affixed to the lower bearing ring, 66, to leave a valley having a width only slightly wider than the width of the head of staple 88. The depth of the valley is greater than the height of the head of staple 88. Staple 88 now will be easily and firmly retained in the formed valley. Shims 92 and 94 can be the same thickness, but preferably one of them will be slightly thicker than the other one in order to enhance the urging of staple 88 into the valley formed therebetween.

Yet another unique pin design is depicted in FIG. 13. A pin, 96, has a pair of ostensibly parallel legs, 98 and 100, connected by a "head", 102, formed in the shape of a "V". Pin 96 can be formed of magnetic metal, such as wire like pin 26 (FIG. 2) and staple 88 (FIG. 10). V head 102 can be captured or held by the magnetic puck assembly (e.g., magnetic puck 22 (FIG. 1), 42 (FIG. 4), 54 (FIG. 6)). Obviously other shapes of head 102 can be envisioned, but the simple V in FIG. 13 economizes on material.

It also is possible to place a non-magnetic wedge atop the magnetic puck in order to further hold pin 96 in place. Such modified puck is illustrated in FIG. 14, where a magnetic puck assembly, 110, is constructed as hereinbefore described. Sitting atop puck 110 is a non-magnetic wedge, 112, like non-magnetic shims 92 and 94 of FIG. 11. Non-magnetic wedge 112, however, is configured to receive head 102 to further ensure it being stably captured by the magnetic puck. The shape of non-magnetic wedge 110 can be such that it conforms to any shape head of the shape.

Any of the applications discussed in the background section can benefit from use of the pins, as inserted using the magnetic puck disclosed herein, including, inter alia, sod, geosynthetic materials (such as used in the construction trade), waterway mattes, any plastic webbing, enhanced vapor, or greenway matting, or the like. For practical purposes, "ground" is considered to be any penetrable surface, i.e. a surface penetrable by an anchoring pin, marker pin or staple, such as one or more of soil, fill, wood, roadway, asphalt, concrete, or building material. There is virtually no limitation to the use of disclosed pins for ground insertion applications in accordance with the precepts of the present disclosure.

Certain puck components, including the non-magnetic shims or wedges, may benefit from the application of a hard-facing, including organic, inorganic, ceramic, and metallic materials, in order to extend the useful life of the magnetic pucks and their (magnetic and non-magnetic) components.

Additionally, while use of a hand-graspable handle is a relatively easy and facile method for ground insertion of pins, it also is conceivable to attach the magnetic puck assemblies to a machine (electric, pneumatic, hydraulic) for "automatic" or power insertion of pins into the ground. So long as the puck assembly as disclosed herein and corresponding "magnetic" pins are used in combination, the motive power used for insertion of the pins (human power, electric power, gasoline/diesel fuel power, hydraulic power, pneumatic power, etc.) is up to the installer and does not form a limitation of the present disclosure.

While the magnetic puck and its use have been described with reference to a preferred embodiment, those skilled in the art will understand that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out the subject matter disclosed herein, but that the disclosure will include all embodiments falling within the scope of the appended claims. In this application all units are in the US system and all amounts and percentages are by weight, unless otherwise expressly indicated. Also, all citations referred herein are expressly incorporated herein by reference.

I claim:

1. A method for inserting an anchoring pin into a penetrable surface, which comprises the steps of:

(A) providing a pin insertion device, which comprises:

(1) a graspable elongate handle having an upper end and a lower end; and (2) a magnetic puck assembly attached to said handle lower end, said magnetic puck assembly configured for picking up one or more anchoring pins with at least a metallic pin head and maintaining it in an insertion position until the pin is inserted into the ground, the magnetic puck assembly further comprising (i) an upper magnetic mounting ring having a central aperture; (ii) a lower magnetic bearing ring having a central aperture and an outer bearing surface; (iii) an annular magnet sandwiched between said upper magnetic mounting ring and said lower magnetic bearing ring, and having a central aperture; and (iv) a magnetic tapered pin inserted within all of said central apertures, being in contact with said upper magnetic mounting ring, and having an attachment end and a bearing end, said magnetic tapered pin bearing end and said lower magnetic bearing ring outer bearing surface forming a planar surface, said magnetic tapered pin bearing end and said lower magnetic bearing ring outer bearing surface being spaced apart at said planar surface, said planar surface for retaining said metallic pin head for its insertion into the penetrable surface;

(B) picking up said anchoring pin with said device;

(C) thrusting said anchoring pin into the penetrable surface with said device;

(D) withdrawing said device, leaving the anchoring pin embedded in the surface.

2. The method of claim 1, using a magnetic puck assembly further comprising a dowel extending partially into said handle, threadingly engaged with said tapered pin by extending into a threaded cavity formed in said tapered pin.

3. The method of claim 1, using the magnetic puck assembly further comprising said annular magnet as a ceramic magnet.

4. The method of claim 1 wherein the magnetic puck assembly is attachable to a hand-graspable handle.

5. The method of claim 4, wherein said handle is one or more of made of wood, made of a plastic, made of a composite material, made of a metal, straight, or a D-handle.

6. The method of claim 1 wherein the pin insertion device or portion thereof is attachable to a machine for mechanically inserting an anchoring pin into the ground.

7. The method of claim 1 wherein the lower magnetic bearing ring of the magnetic puck assembly retains a pair of flat non-magnetic members spaced apart to create a valley that extends to said lower magnetic bearing ring, said valley configured to receive the head of a staple.

8. The method of claim 1 wherein the penetrable surface is one or more of soil, fill, wood, roadway, asphalt, concrete, or building material.

9. The method of claim 8 wherein the penetrable surface is soil or fill in a waterway.

10. The method of claim 1 wherein the method is used as part of an erosion control system.

11. The method of claim 1 wherein the method is used to retain one or more of erosion control mat, landscape cloth, tarp, building paper, tarpaper, erosion control cloth, or paper.

12. A method for inserting an anchoring pin into a penetrable surface, which comprises the steps of:

(A) providing a pin insertion device, comprising a magnetic puck assembly for picking up a metallic anchoring pin and maintaining it in an insertion position until the pin is inserted into the ground, said magnetic puck assembly further comprising a handle;

an upper magnetic mounting ring having a central aperture and attached to a handle;

a lower magnetic bearing ring having a central aperture and an outer bearing surface;

an annular magnet sandwiched between said upper mounting ring and said lower bearing ring, and having a central aperture;

a magnetic tapered pin inserted within all of said central apertures and being in contact with said upper mounting ring, but being spaced apart from said lower bearing ring and having an attachment end and a bearing end, wherein said magnetic tapered pin bearing end and said lower bearing ring outer bearing surface form a planar surface for retaining a metallic anchoring pin for its insertion into the ground; and a dowel extending partially into said handle and being threadingly engaged with said magnetic tapered pin by extending into a threaded cavity formed in said tapered pin;

(B) picking up said anchoring pin with said device;

(C) thrusting said anchoring pin into the penetrable surface with said device;

(D) withdrawing said device, leaving the anchoring pin embedded in the surface.

13. The method of claim 12 wherein the magnetic puck assembly is attachable to a hand-graspable handle.

14. The method of claim 13, wherein said handle is one or more of made of wood, made of a plastic, made of a composite material, made of a metal, straight, or a D-handle.

15. The method of claim 12 wherein the pin insertion device or portion thereof is attachable to a machine for mechanically inserting an anchoring pin into the penetrable surface.

16. The method of claim 12 wherein the penetrable surface is one or more of soil, fill, wood, roadway, asphalt, concrete, or building material.

17. A method for inserting an anchoring pin into a penetrable surface, which comprises the steps of:

(A) providing a pin insertion device, comprising a magnetic puck assembly for picking up a metallic anchoring pin and maintaining it in an insertion position until the pin is inserted into the penetrable surface, said device further comprising an upper magnetic mounting ring having a central aperture; a lower magnetic bearing ring having a central aperture, an outer bearing surface, and retaining a pair of flat non-magnetic members spaced apart to create a valley that extends to said lower magnetic bearing ring, said valley configured to receive the head of a staple; an annular magnet sandwiched between said upper mounting ring and said lower bearing ring, and having a central aperture; and a magnetic tapered pin inserted within all of said central apertures and being in contact with said upper mounting ring, but being spaced apart from said lower bearing ring and having an attachment end and a bearing end, wherein said magnetic tapered pin bearing end and said lower bearing ring outer bearing surface form a planar surface for retaining a metallic anchoring pin for its insertion into the penetrable surface;

(B) picking up said anchoring pin with said device;

(C) thrusting said anchoring pin into the penetrable surface with said device;

(D) withdrawing said device, leaving the anchoring pin embedded in the surface.

18. The method of claim 17 wherein the method is used to retain one or more of erosion control mat, landscape cloth, tarp, building paper, tarpaper, erosion control cloth, or paper.

19. The method of claim 17 wherein the penetrable surface is soil or fill.

20. The method of claim 17 wherein the method is used as part of an erosion control system.

* * * * *